US006032585A

United States Patent [19]

Pinch

[11] Patent Number: 6,032,585

[45] Date of Patent: Mar. 7, 2000

[54] FOLDING BANQUET TABLE

[75] Inventor: Daniel R. Pinch, Clermont, Fla.

[73] Assignee: Cosco, Inc., Columbus, Ind.

[21] Appl. No.: 08/908,625

[22] Filed: Aug. 7, 1997

Related U.S. Application Data

[60] Provisional application No. 60/023,604, Aug. 9, 1996.

[51] Int. Cl.[7] ..... A47B 3/00

[52] U.S. Cl. ..... 108/36; 108/129

[58] Field of Search ..... 108/36, 167, 168, 108/169, 170, 115, 129, 130, 131, 132, 133

[56] References Cited

U.S. PATENT DOCUMENTS

| | | | |
|---|---|---|---|
| 1,614,187 | 1/1927 | Coggins . | |
| 1,976,140 | 10/1934 | Paul . | |
| 2,542,394 | 2/1951 | Cohen . | |
| 3,025,120 | 3/1962 | Howe | 108/167 |
| 3,170,417 | 2/1965 | Avidiya . | |
| 3,368,504 | 2/1968 | Cohen . | |
| 4,157,089 | 6/1979 | Loughrey | 108/167 X |
| 4,838,180 | 6/1989 | Gutgsell . | |
| 4,841,877 | 6/1989 | Virtue | 108/167 X |
| 4,862,611 | 9/1989 | Wright . | |
| 5,109,778 | 5/1992 | Berkowitz et al. . | |
| 5,154,441 | 10/1992 | White et al. . | |
| 5,279,233 | 1/1994 | Cox . | |
| 5,323,713 | 6/1994 | Luyk et al. . | |
| 5,357,872 | 10/1994 | Wilmore . | |
| 5,365,861 | 11/1994 | Gutgsell . | |
| 5,390,610 | 2/1995 | Gutgsell . | |
| 5,421,272 | 6/1995 | Wilmore . | |
| 5,445,085 | 8/1995 | Westerburgen . | |
| 5,623,882 | 4/1997 | Price . | |

FOREIGN PATENT DOCUMENTS

| | | | |
|---|---|---|---|
| 626807 | 7/1949 | United Kingdom | 108/167 |

OTHER PUBLICATIONS

MITY–LITE™ Tables & Chairs catalog, four pages, date unknown.

CORE–A–GATOR™ folding table literature from Virco Mfg. Corporation, onepage, 1996.

Folding table literature from Business & Institutional Furniture Company, two pages, date unknown.

Folding table literature from Palmer Snyder, two pages, 1996.

Folding table literature, Adirondack Direct catalog, cover sheet and p. 72, date unknown.

Folding table literature, CH Office Products, p. 414, date unknown.

Folding table literature, Meco Corporation, two pages, date unknown.

Folding table advertisement, CHEF'S catalog, p. C598, date unknown.

*Primary Examiner*—Jose V. Chen

*Attorney, Agent, or Firm*—Barnes & Thornburg

[57] ABSTRACT

A table includes first and second sections coupled together for pivotable movement therebetween and a pair of legs pivotably coupled to the respective sections to move between storage and support positions. The table further includes a pair of channels coupled to each section, a pair of struts coupled to each respective channel to slide therein, and a pair of collars having two substantially identical pieces pivotably coupling each strut to a leg. The table also includes a reinforcing assembly including a pair of rails coupled to the respective sections and a support pivotable relative to one rail and slidable relative to the other rail to provide a rigid member supporting the sections.

50 Claims, 5 Drawing Sheets

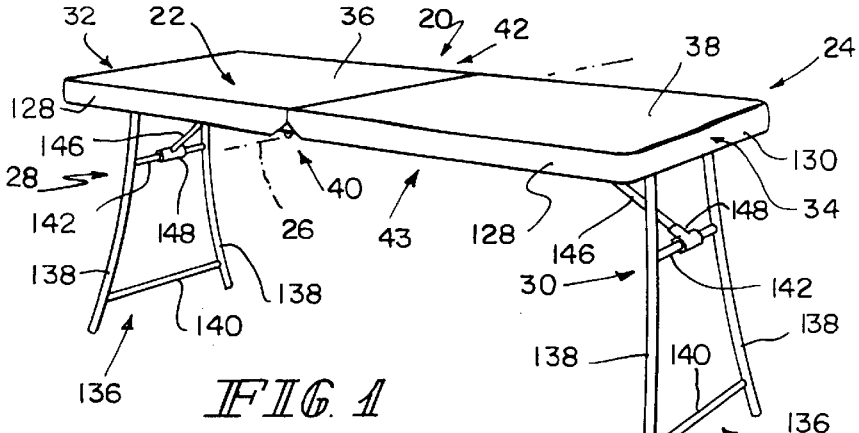
FIG. 1
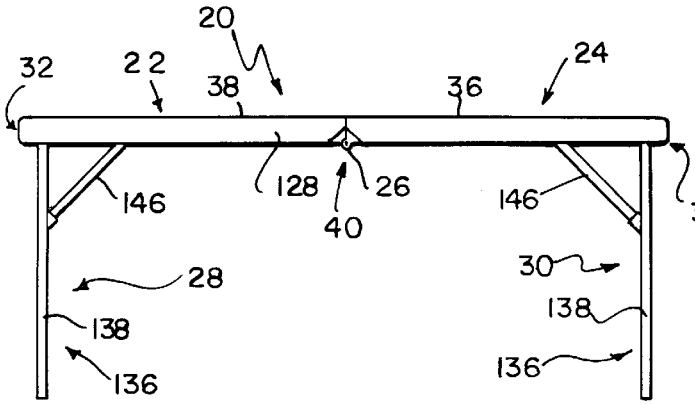
FIG. 2
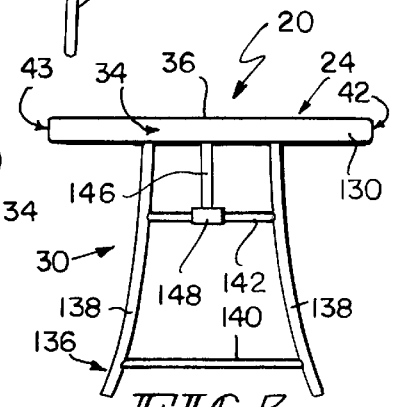
FIG. 3
FIG. 5
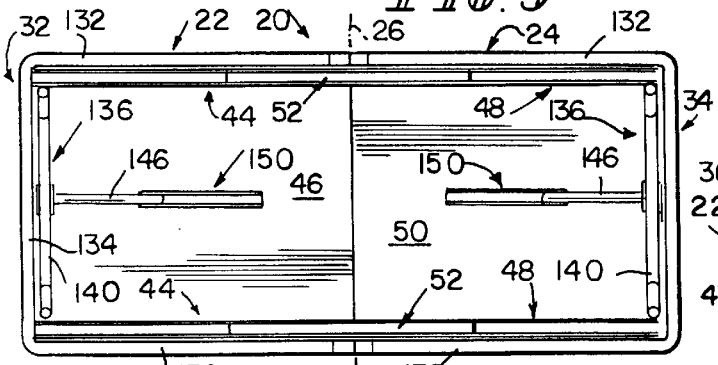
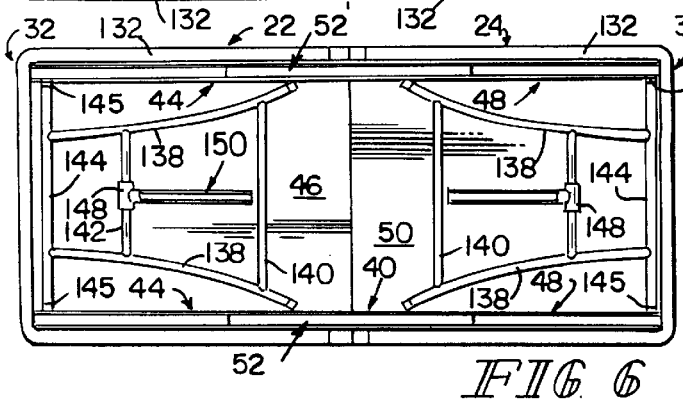
FIG. 6
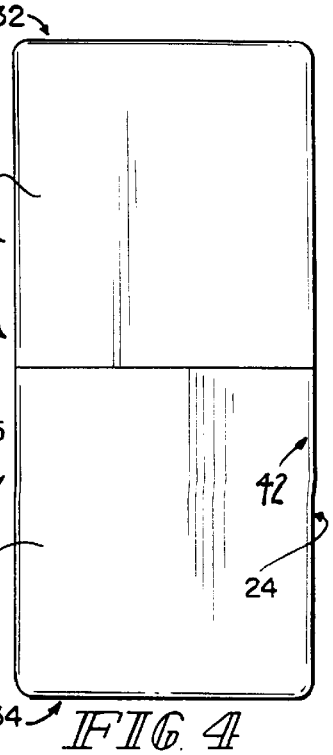
FIG. 4

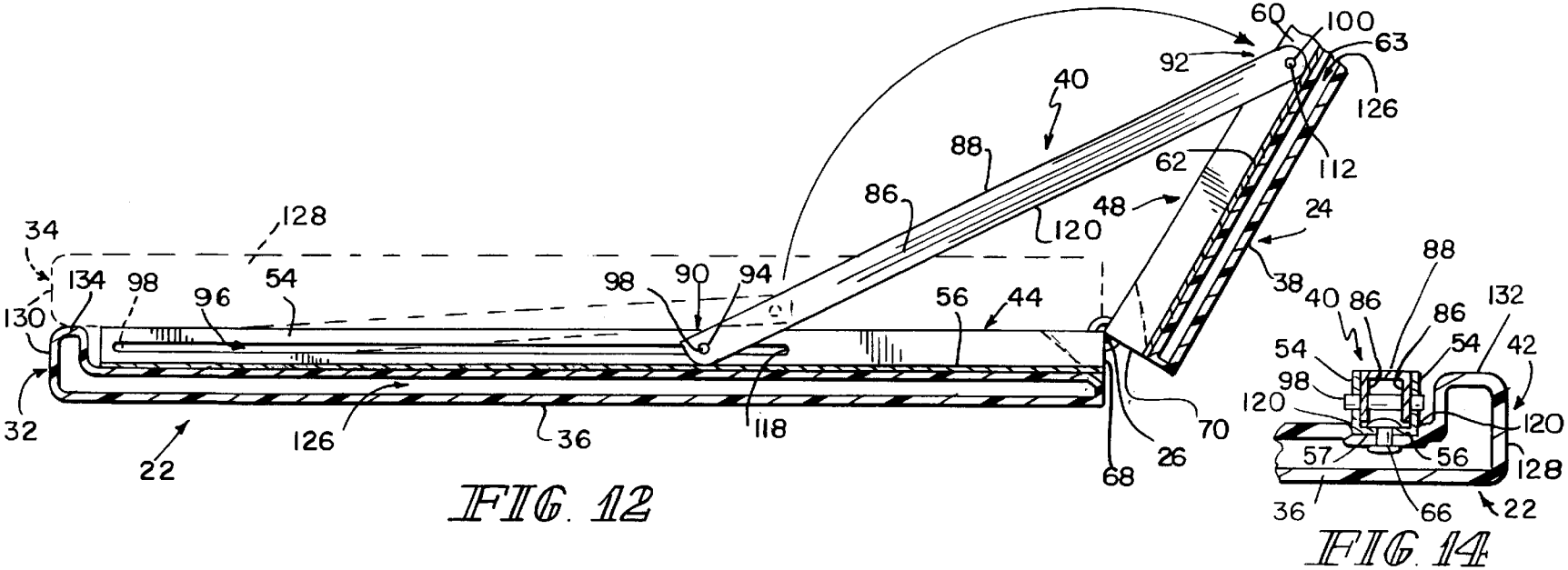
FIG. 12
FIG. 14
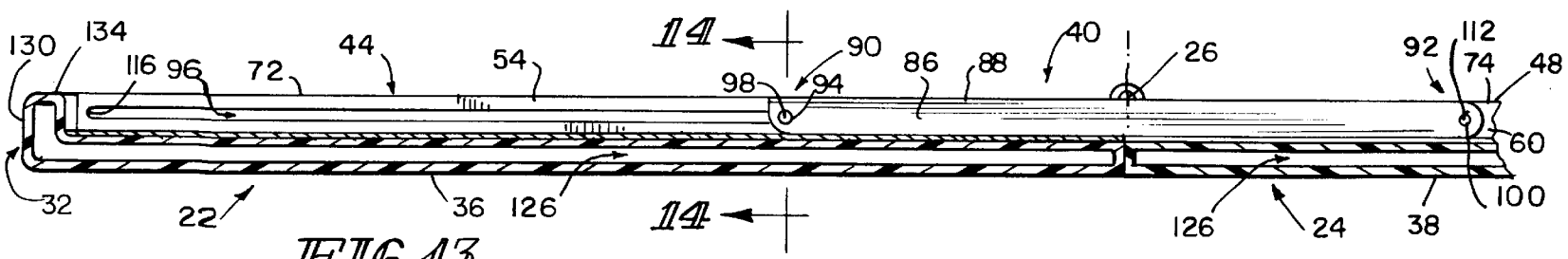
FIG. 13

FOLDING BANQUET TABLE

This application claims benefit of Provisional Application 60/023,604 filed Aug. 9, 1996.

BACKGROUND AND SUMMARY OF THE INVENTION

The present invention relates to a folding table and particularly to a folding banquet table having two table sections that can fold between an opened table position having top surfaces of the table sections aligned in coplanar relation to form a large table surface and a collapsed position having the table sections folded together. More particularly, the present invention relates to a folding table having a reinforcing assembly for supporting the table sections in the table position.

Tables having two table sections coupled together for pivoting movement between an opened table position and a folded collapsed position are well known. Conventional folding tables typically include table legs that can fold against the table sections allowing the table sections to be folded compactly together without interference from the table legs. See, for example, U.S. Pat. No. 5,445,085 to Westerburgen; U.S. Pat. No. 5,421,272 to Wilmore; U.S. Pat. No. 5,357,872 to Wilmore; U.S. Pat. No. 3,368,504 to Cohen; and U.S. Pat. No. 2,542,394 to Cohen et al.

Some folding tables include mechanisms for rigidifying the table sections while in the table position so that the table is more sturdy and can carry more weight than otherwise would be possible without such rigidifying mechanisms. See, for example, U.S. Pat. No. 5,445,085 to Westerburgen; U.S. Pat. No. 5,421,272 to Wilmore; U.S. Pat. No. 5,357,872 to Wilmore; U.S. Pat. No. 3,368,504 to Cohen; and U.S. Pat. No. 2,542,394 to Cohen et al.

According to the present invention, a folding table includes a first table section coupled to a second table section for pivoting movement about a transversely-extending central pivot axis. The first and second table sections can pivot between an opened table position wherein top surfaces of the first and second table sections are aligned in coplanar relation to form a large elongated table surface and a collapsed position wherein the first and second table sections are folded together. The folding table has a reinforcing assembly that includes a support rail having a first end slidably connected to a first table rail mounted to an undersurface of the first table section and having a second end pivotably connected to a second table rail mounted to an undersurface of the second table section.

When the folding table is opened from the collapsed position, the support rail pivots relative to the second section while sliding relative to the first section until a bracing edge of the support rail simultaneously engages the first and second table rails at which point the first and second table sections are aligned with one another in the table position. Engagement of the support rail with the first and second table rails prevents the first and second table sections from opening past the table position thus reinforcing the first and second table sections in the table position.

In preferred embodiments, the support rail of the reinforcing assembly automatically reinforces the first and second table sections in the table position without having to adjust the support rail manually after the table sections have been unfolded to the table position. The reinforcing assembly is also configured so that the table sections can be folded from the table position to the collapsed position without having to first adjust the support rail manually. In addition, the folding table includes leg assemblies mounted to each of the table sections so that legs of the leg assemblies can be folded from a stored position adjacent to the respective table sections to a support position extending away from the respective table sections to elevate the table sections above a surface on which the folding table sets.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 1 is a perspective view of a folding table in accordance with the present invention showing first and second table sections opened to a table position wherein top surfaces of the first and second table sections are aligned in coplanar relation to form an upwardly-facing elongated table surface and showing a leg assembly mounted to undersurfaces of each of the first and second table sections, each leg assembly including a leg moved to a support position and extending downwardly from the first and second table sections;

FIG. 2 is a side elevation view of the folding table of FIG. 1 showing angled support struts extending from each of the legs to the respective first and second table sections to support the legs in the support positions;

FIG. 3 is an end elevation view of the folding table of FIG. 2 showing one of the angled support struts being coupled to a central portion of an upper cross member of one of the legs by a coupling collar which is pivotably mounted to the upper cross member;

FIG. 4 is a top plan view of the folding table of FIG. 3 showing the top surfaces of the first and second table sections aligned to form the elongated table surface;

FIG. 5 is a bottom plan view of the folding table of FIG. 4 showing the leg assemblies extended to respective support positions, the support struts extending from the legs to respective first and second channel members which are centrally mounted to undersurfaces of the first and second table sections, a pair of spaced-apart reinforcing assemblies mounted near lateral sides of the first and second table sections, and the reinforcing assemblies including a support rail extending across the first and second table sections and engaging respective first and second table rails to reinforce the first and second table sections in the table position;

FIG. 6 is a bottom plan view of the folding table of FIG. 5 in the table position showing the leg assemblies in their respective stored positions having the support struts positioned to lie within longitudinal channels defined by side walls of the respective first and second channel members and showing the support rails in a reinforcing position spanning the first and second table sections, the support rails being positioned to lie within longitudinal channels defined by side walls of respective first and second table rails;

FIG. 12 is a sectional view of the folding table of FIGS. 1–11 taken along line 12—12 of FIG. 11 through the longitudinal channels of the first and second table rails with portions broken away, showing the second table section in the collapsed position (in phantom) having the first end of the support rails adjacent to the end rims of the first and second table sections and having the second end of the support rails positioned to lie adjacent to an innermost slot edge of the slots formed in the first table rails, the second table section pivoted toward the table position to an intermediate position, and the sliding pin sliding within the slot toward the innermost slot edge of the slot formed in the first table rail while the support rails pivot relative to the second table rails and second table section;

FIG. 13 is a sectional view of the folding table similar to FIG. 12, with portions broken away, showing the first and second table sections in the table position, the support rails in parallel relation with the first and second table sections inside the longitudinal channels of the first and second table rails, and the support rails having a bracing edge engaging mounting walls of the first and second support rails to prevent the first and second table sections from opening past the table position;

FIG. 14 is a sectional view taken along line 14—14 of FIG. 13, with portions broken away, showing the side walls and mounting wall of the first table rails forming a U-shaped cross section defining the channel which receives the support rails, the first table rail being received by the recess formed in the undersurface of the first table section, and one of the side rims of the first table section shielding the first table rail from view;

DETAILED DESCRIPTION OF THE DRAWINGS

Figure 7:
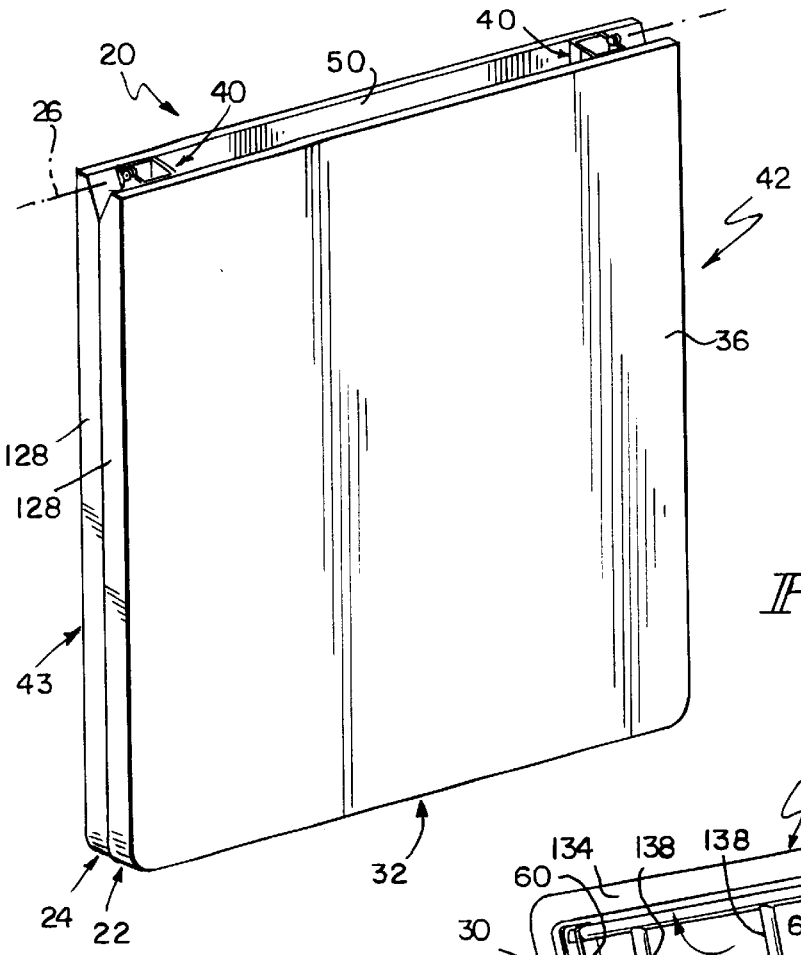
FIG. 7 is a perspective view of the folding table of FIG. 1 showing the first and second table sections folded to a collapsed position having the top surfaces of the first and second table sections facing in opposite directions and having each of the leg assemblies in a stored position adjacent to respective undersurfaces of the first and second table sections so that the leg assemblies are hidden from view when the folding table is in the collapsed position.

A folding table 20 in accordance with the present invention includes a first table section 22 coupled to a second table section 24 for pivoting movement about a transversely-extending central pivot axis 26, a first leg assembly 28 mounted to first table section 22, and a second leg assembly 30 mounted to second table section 24, as shown in FIG. 1. First and second table sections 22, 24 can fold about pivot axis 26 between a table position, shown in FIGS. 1–5, wherein an end 32 of first table section 22 is horizontally spaced apart from an end 34 of second table section 24 and a collapsed position, shown best in FIG. 7, wherein end 32 of first table section 22 is adjacent to end 34 of second table section 24.

First table section 22 includes a top surface 36 and second table section 24 includes a top surface 38. Top surface 36 of first table section 22 and top surface 38 of second table section 24 are aligned in coplanar relation to form an elongated upwardly-facing table surface 36, 38 when first and second table sections 22, 24 are in the table position, as shown in FIGS. 1 and 4. In addition, top surface 36 and top surface 38 are substantially parallel and face in opposite directions when first and second table sections 22, 24 are in the collapsed position, as shown in FIG. 7.

Figure 8:
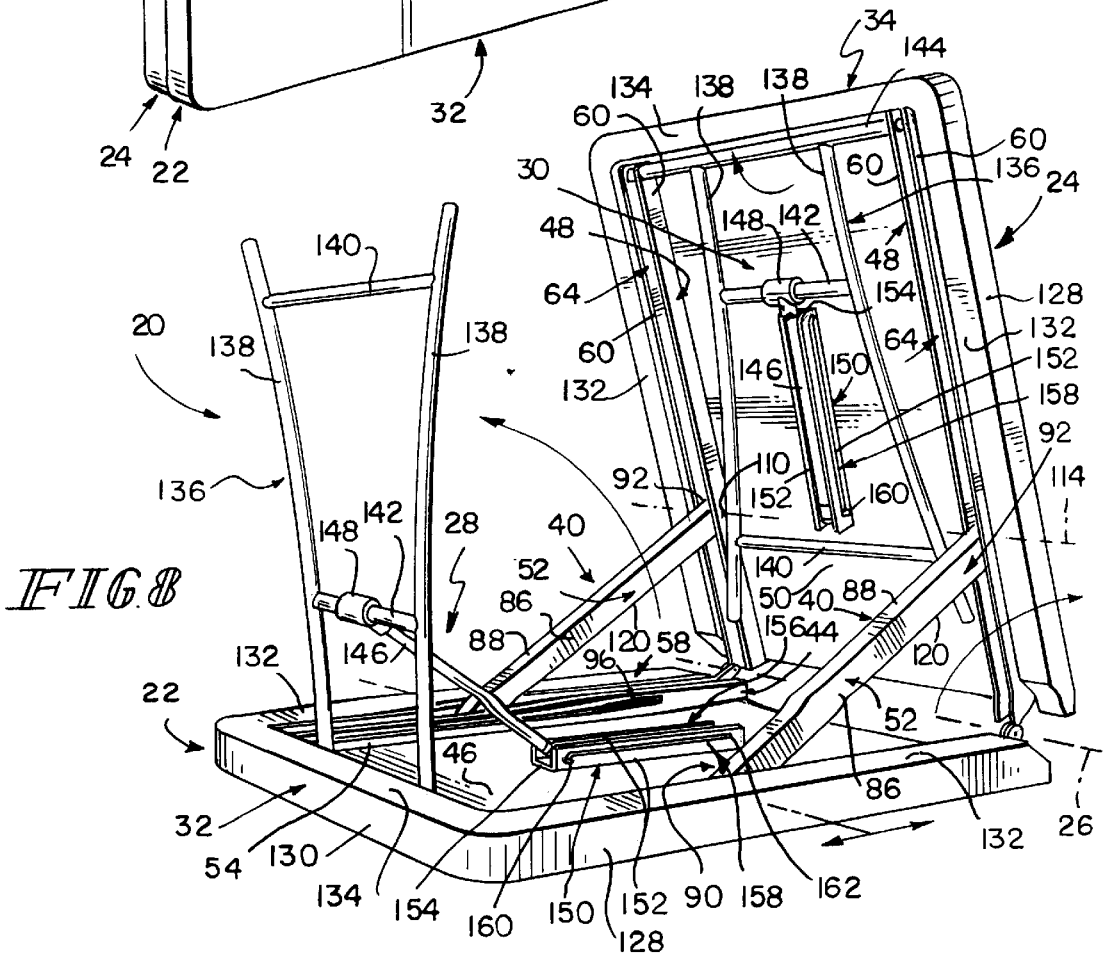
FIG. 8 is a perspective view of the folding table of FIG. 7 in a partially opened position showing the first table section coupled to the second table section for pivoting movement about a transversely-extending central pivot axis, one of the leg assemblies in the stored position, the other of the leg assemblies unfolded to the support position having the respective support strut extending from the coupling collar to a respective channel member, the support rails angling between the first and second table sections, each of the support rails having a first end slidably mounted to the first table section by the first table rail, and each of the support rails having a second end pivotably mounted to the second table section by the second table rail.
Figures 9, 10, 11:
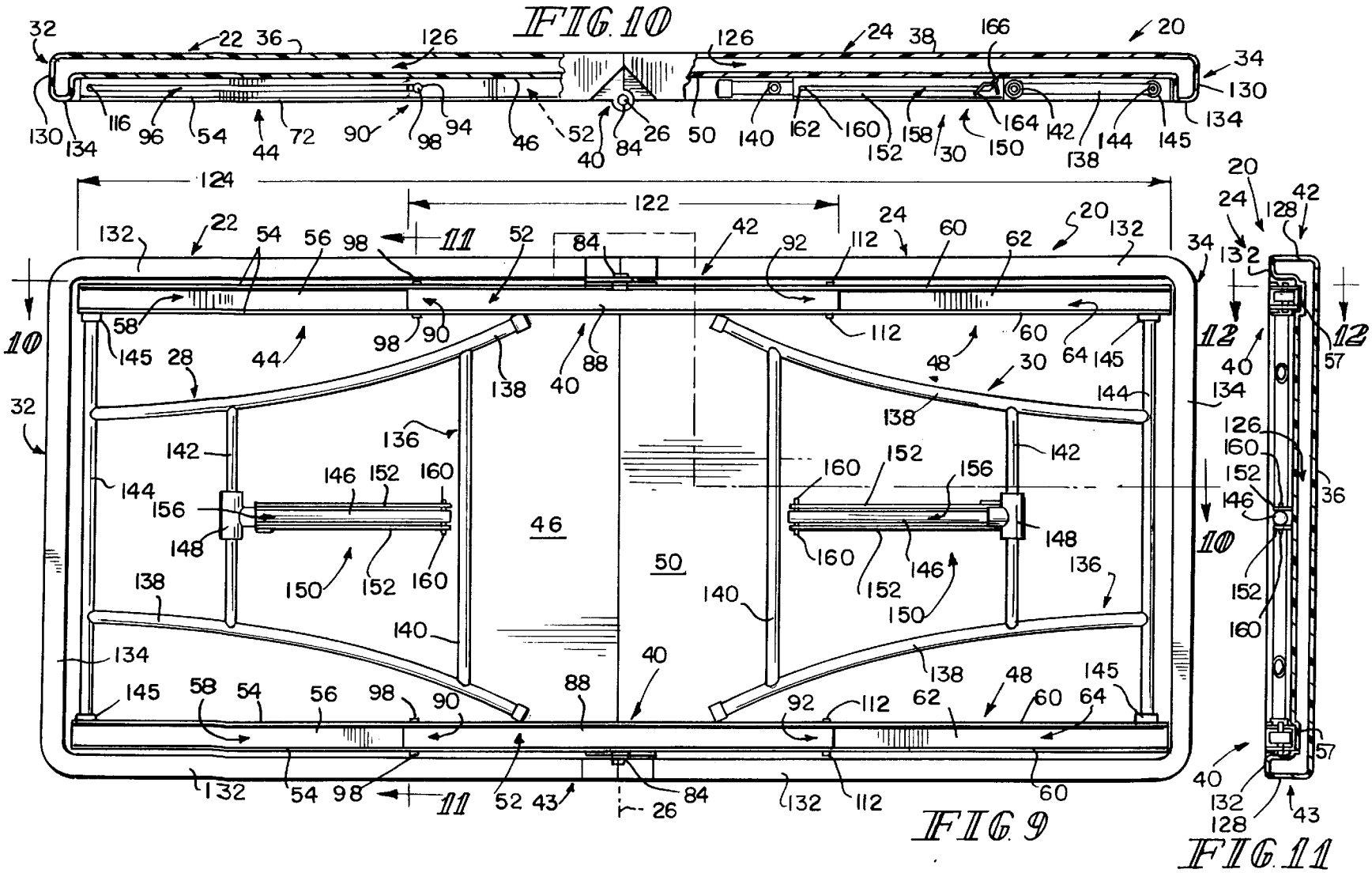
FIG. 9 is an enlarged bottom plan view of the folding table similar to FIG. 6.
FIG. 10 is a sectional view taken along line 10—10 of FIG. 9 showing one of the support rails in the reinforcing position, a sliding pin of the reinforcing assembly received by slots formed in the side walls of one of the first table rails so that the support rail can slide relative to the first table rail when the table is opened and collapsed, a slide pin of one of the leg assemblies mounted to the second section and received by slots formed in side walls of the channel member so that the support strut can slide relative to the channel member when the leg is pivoted between the stored position and the support position, and the first and second table sections each having end rims that project downwardly from ends of respective first and second table sections to shield the first and second table rails from view.
FIG. 11 is a sectional view taken along line 11—11 of FIG. 9 showing the support rails positioned to lie within the channels formed by the side walls of the first table rails, the undersurface of the first table section formed to include a pair of spaced-apart recesses, each recess receiving a corresponding first table rail, the first table section formed to include an interior cavity, and the first table section having side rims that are integral with the end rim of the first table section and that shield the first table rails from view.

First and second table sections 22, 24 are coupled together by a pair of spaced-apart reinforcing assemblies 40 as shown in FIG. 8. Each reinforcing assembly 40 is mounted to first and second table sections 22, 24 adjacent to a respective first and second lateral side 42, 43 of table 20. Each reinforcing assembly 40 includes a first table rail 44 mounted to an undersurface 46 of first table section 22, a second table rail 48 mounted to an undersurface 50 of second table section 24, and a support rail 52 slidably coupled to first table rail 44 and pivotably coupled to second table rail 48, as shown in FIGS. 6, 8 and 9.

Reinforcing assembly 40 adjacent to first lateral side 42 of table 20 and the operation of reinforcing assembly adjacent to first lateral side 42 of table 20 is substantially the same as reinforcing assembly 40 adjacent to second lateral side 43 of table 20 and the operation of reinforcing assembly 40 adjacent to second lateral side 43 of table 20. Therefore, the description below of reinforcing assembly 40 adjacent to first lateral side 42 of table 20 and the operation of reinforcing assembly adjacent to first lateral side 42 of table 20 applies as well to reinforcing assembly 40 adjacent to second lateral side 43 of table 20 and the operation of reinforcing assembly 40 adjacent to second lateral side 43 of table 20 unless specifically noted otherwise.

First table rail 44 includes a pair of spaced-apart side walls 54 and a mounting wall 56 connecting side walls 56 so that first table rail 44 has a U-shaped cross section defining a longitudinally-extending first channel 58 having uniform height and width. Mounting wall 56 is received by an elongated recess 57 formed in undersurface 46 of first table section 22 and is mounted to first table section 22 by suitable fastening means so that side walls 56 are perpendicular to undersurface 46 of first table section 22.

Similarly, second table rail 48 includes a pair of spaced-apart side walls 60 and a mounting wall 62 connecting side walls 60 so that second table rail 48 has a U-shaped cross section defining a longitudinally-extending second channel 64 having uniform height and width. Mounting wall 62 is received by an elongated recess 63 formed in undersurface 50 of second table section 24 and is mounted to second table section 24 by suitable fastening means so that side walls 60 are perpendicular to undersurface 50 of second table section 24. In the illustrative and preferred embodiment of table 20 a plurality of screws 66 are used to fasten first and second table rails 44, 48 to respective first and second table sections 22, 24.

Figure 15:
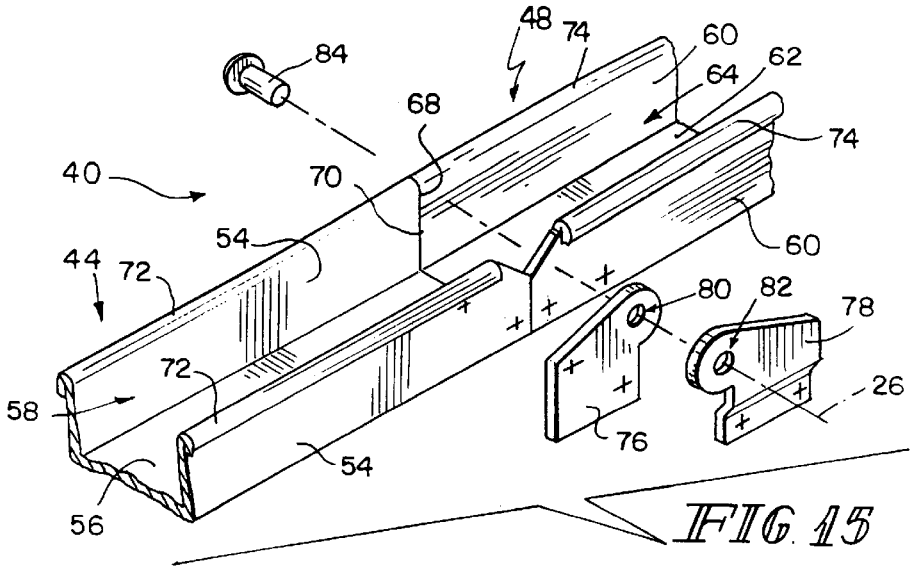
FIG. 15 is a perspective view of the first and second table rails of the folding table of FIGS. 1–14, with portions broken away, showing a first hinge plate mounted to the first table rail, a second hinge plate mounted to the second table rail, apertures formed in each of the first and second hinge plates, a pivot pin received by the apertures to pivotably couple the first and second table rails together, and chamfered corners on one side wall of each of the first and second table rails so that the pivot pin can be inserted into the apertures of the first and second hinge plates.

First and second table rails 44, 48 are fixed to first and second table sections 22, 24, respectively, so that when first and second table sections 22, 24 are in the table position, first and second table rails 44, 48 are aligned in an end-to-end configuration having an end surface 68 of first table rail abutting an end surface 70 of second table rail 48, as shown in FIG. 15. When first and second table sections 22, 24 are in the collapsed position, first and second table rails 44, 48 are folded together in a side-by-side configuration having rail edges 72 of first table rail 44 abutting rail edges 74 of second table rail 48.

Reinforcing assembly 40 includes a first hinge plate 76 attached to first table rail 44 and a second hinge plate 78 attached to second table rail 48, as shown in FIG. 15. First hinge plate 76 is formed to include a first aperture 80 and second hinge plate 78 is formed to include a second aperture 82. A pivot pin 84 is received by first and second apertures 80, 82 to pivotably couple first and second table rails 44, 48 to one another which ultimately pivotably couples first and second table sections 22, 24 to one another. The outer side wall 54, 60 of each of the first and second table rails 44, 48 have chamfered corners so that pivot pin 84 has room to be inserted into first and second apertures 80, 82 of first and second hinge plates 76, 78. Pivot pin 84 cooperates with first and second hinge plates 76, 78 to define central pivot axis 26 about which first and second table sections 22, 24 pivot.

Support rail 52 includes a pair of spaced-apart bracing walls 86 and a bottom wall 88 connecting bracing walls 86 so that support rail 52 has a U-shaped cross section, as shown in FIGS. 11 and 14. Bottom wall 88 of support rail 52 has a width that is slightly narrower than mounting walls 56, 62 of first and second table rails 44, 48 allowing a first end 90 of support rail to be received within first channel 58 of first table rail 44 and allowing a second end 92 of support rail 52 to be received within second channel 64 of second table rail 48.

Each bracing wall 86 of support rail 52 is formed to include an aperture 94 adjacent to first end 90 of support rail 52. Each side wall 54 of first table rail 44 is formed to include an elongated slot 96. A sliding pin 98 is received by apertures 94 and slots 96 so that first end 90 of support rail 52 is slidably coupled to first table section 22 by first table rail 44. Sliding pin 98 automatically slides in slots 96 during pivoting movement of first and second table sections 22, 24 about central pivot axis 26 between the table position and the collapsed position.

Additionally, each bracing wall 86 of support rail 52 is formed to include an aperture 100 adjacent to second end 92 of support rail 52 and each side wall 60 of second table rail 48 is formed to include an aperture 110. A pivot pin 112 is received by apertures 100 and apertures 110 so that second end 92 of support rail 52 is pivotably coupled to second table section 24 by second table rail 48. Support rail 52 automatically pivots relative to second table rail 48 and second table section 24 about a transversely-extending pivot axis 114 during pivoting movement of first and second table sections 22, 24 about central pivot axis 26 between the table position and the collapsed position.

When first and second table sections 22, 24 are in the collapsed position, support rail 52 is substantially contained within first and second channels 58, 64 of first and second table rails 44, 48 in a stored position. In the stored position, approximately one half of support rail 52 is contained within first channel 58 of first table rail 44 and approximately one half of support rail 52 is contained within second channel 64 of second table rail 48 while the first and second table rails are in the side-by-side configuration. When support rail 52 is in the stored position, first end 90 of support rail 52 is adjacent to end 32 of first table section 22 and sliding pin 98 is adjacent to an outermost slot edge 116 defining an outer end of slot 96. In addition, second end 92 of support rail 52 is positioned to lie adjacent to slot 96, as shown best in FIG. 12 (in phantom).

When first and second table sections 22, 24 unfold about central pivot axis 26 from the collapsed position toward the table position, support rail 52 automatically pivots about pivot axis 114 relative to second table rail 48 pulling sliding pin 98 away from outermost slot edge 116 and toward an innermost slot edge 118 defining an inner end of slot 96 so that first end 90 of support rail 52 travels within first channel 58 toward central pivot axis 26. A substantial portion of support rail 52 is withdrawn from first and second channels 58, 62 during movement of first and second table sections 22, 24 between the table position and the collapsed position, as shown in FIGS. 8 and 12.

When first and second table sections 22, 24 are in the table position, support rail 52 is substantially contained within first and second channels 58, 64 of first and second table rails 44, 48 in a reinforcing position. In the reinforcing position, approximately one half of support rail 52 is contained within first channel 58 of first table rail 44 and approximately half of support rail 52 is contained within second channel 64 of second table rail 48 while the first and second table rails 44,48 are in the end-to-end configuration.

When support rail 52 is in the reinforcing position, sliding pin 98 is adjacent to innermost slot edge 118 and support rail 52 is substantially parallel to first and second table rails 44, 48 and first and second table sections 22, 24. In addition, bracing edges 120 of bracing walls 86 simultaneously engage mounting wall 56 of first table rail 44 and mounting wall 62 of second table rail 48 so that first and second table sections 22, 24 are reinforced in the table position and so that first and second table sections 22, 24 are prevented from opening past the table position.

When first and second table sections 22, 24 are in the table position and objects (not shown) are placed on top surfaces 36, 38 of first and second table sections 22, 24, the weight of the objects are distributed through sliding pin 98 and pivot pin 112 to first and second table rails 44, 48, respectively. Preferred and illustrative reinforcing assembly 40 is constructed so that support rail 52 has a length 122 that is approximately one third of a length 124 that is defined by first and second table rails 44, 48 when in the end-to-end configuration as shown in FIG. 9. Length 122 of support rail 52 is maximized so that bracing edges 120 contact as much of mounting wall 56 of first table rail 44 and mounting wall 62 of second table rail 48 as possible when first and second table sections 22, 24 are in the table position while still allowing first and second table sections 22, 24 to fold against one another in the collapsed position.

Movement of reinforcing assembly 40 when first and second table sections 22, 24 are folded from the table position toward the collapsed position is similar but opposite to the movement of reinforcing assembly 40 when first and second table sections 22, 24 are unfolded from the collapsed position toward the table position. For example, support rail 52 pushes sliding pin 98 away from innermost slot edge 118 and toward outermost slot edge 116, and first end 90 of support rail travels in first channel 58 of first table rail 48 away from central pivot axis 26.

First and second table sections 22, 24 of preferred and illustrative table 20 are each made from a plastics material and are blow molded so that an interior cavity 126 is formed between top surfaces 36, 38 and undersurfaces 46, 50 of respective first and second table sections 22, 24. However, it is within the scope of the invention as presently perceived for first and second table sections 22, 24 to be made of a non-plastics material, such as wood, and to have a solid interior region rather than cavity 126.

First and second table sections 22, 24 are each formed to include lateral rims 128 which project from top surfaces 36, 38 beyond undersurfaces 46, 50 along lateral sides 42, 43 of table 20 and end rims 130 which project from top surfaces 36, 38 beyond undersurfaces 46, 50 along ends 32, 34 of first and second table sections 22, 24, respectively. Lateral rims 128 and end rims 130 shield respective first and second table rails 44, 48 from view, as shown in FIGS. 1–4.

Elongated recesses 57 in which first table rails 44 are received and elongated recesses 63 in which second table rails 48 are received are positioned to lie adjacent to a corresponding lateral rim 128, as shown in FIGS. 11 and 14. When first and second table sections 22, 24 are in the collapsed position, bottom surfaces 132 of lateral rims 128 of respective first and second table sections 22, 24 abut one another and bottom surfaces 134 of end rims 130 of respective first and second table sections 22, 24 abut one another so that both reinforcing assemblies 40 are substantially encased by first and second table sections 22, 24, as shown in FIG. 7.

As previously described, table 20 includes first leg assembly 28 mounted to first table section 22 and second leg assembly 30 mounted to second table section 24. First leg assembly 28 and the operation of first leg assembly 28 is substantially the same as second leg assembly 30 and the operation of second leg assembly 30. Therefore, the description below of first leg assembly 28 and the operation of first leg assembly 28 applies as well to second leg assembly 30 and the operation of second leg assembly 30 unless specifically noted otherwise.

First leg assembly 28 includes a leg 136 having a pair of spaced-apart curved uprights 138, a lower cross member 140 extending transversely between uprights 138 adjacent to lower portions of uprights 138, an upper cross member 142 extending transversely between middle portions of uprights 138, and a pivot member 144 to which upper portions of uprights 138 are attached, as shown in FIGS. 6, 8 and 9. First leg assembly 28 also includes a support strut 146 which is pivotably coupled to a central portion of upper cross member 142 by a coupling collar 148 and a channel member 150 which is mounted to undersurface 46 of first table section 22 between lateral rims 128, as also shown in FIGS. 6, 8 and 9. Pivot member 144 is coupled to first table rails 44 for pivoting movement relative to first table section 22 by a pair of spaced-apart pivot collars 145, as shown in FIG. 9.

Figure 17:
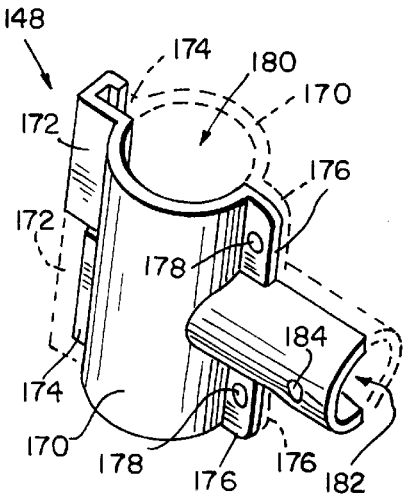
FIG. 17 is a perspective view of the coupling collar of each leg assembly which couples the support struts to the legs showing the coupling collar made up of two opposing identical half pieces, each half piece including a bent flange that mates with a straight flange of the opposing half piece to hold the half pieces together, each half piece including two fastening plates each having an aperture so that the half pieces can be fastened together, a transverse opening which receives an upper cross member of the leg for pivoting movement, and a longitudinal opening which receives the support strut.

Coupling collar 148 of preferred and illustrative table 20 is made up of two opposing identical half pieces 170 which are molded from a plastics material. Each half piece 170 is formed to include a bent flange 172 that mates with a straight flange 174 of opposing half piece 170 to hold half pieces 170 together, as shown in FIG. 17. In addition, each half piece 170 is formed to include two fastening plates 176 and each fastening plate is formed to include an aperture 178. Apertures 178 of each half piece 170 align so that a fastening bolt (not shown) or other suitable fastening element can be received by the aligned apertures to fasten half pieces 170 together.

When half pieces 170 are mounted on upper cross member 142 of leg 136 and fastened together, a transverse opening 180 which receives upper cross member 142 for pivoting movement is formed by half pieces 170. In addition, a longitudinal opening 182 which receives support strut 146 is also formed when half pieces 170 are fastened together. An aperture 184 is also provided on each half piece 170 so that coupling collar 148 can be fastened to support strut 146.

Figure 16:
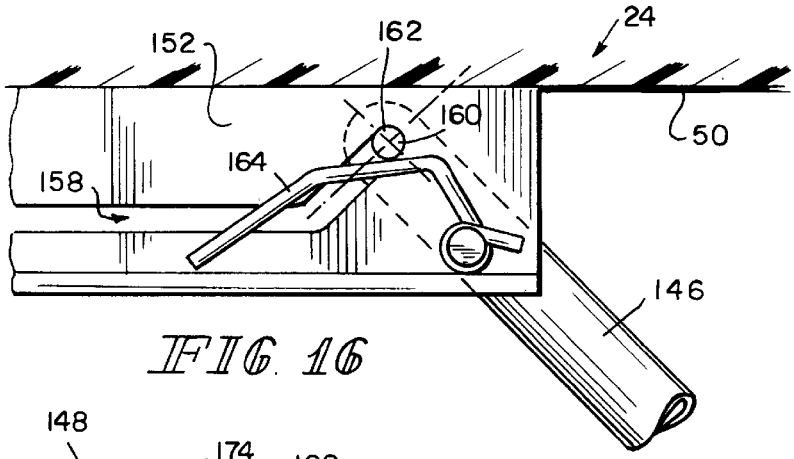
FIG. 16 is a side view of the channel member of one of the leg assemblies, with portions broken away, showing a bent leaf spring mounted to a side wall of the channel member to bias a slide pin which couples the support strut to the channel member into engagement with an outermost slot edge of the slot to lock the leg in the support position.

Channel member 150 includes a pair of spaced-apart side walls 152 and a mounting wall 154 connecting side walls 152 so that channel member 150 has a U-shaped cross section defining a longitudinally-extending slide channel 156 having uniform height and width. Mounting wall 156 is fixed to undersurface 46 of first table section 22 by suitable fastening means and each side wall 152 is formed to include a slot 158. Slots 158 extend generally longitudinally and parallel with undersurface 46 but an end portion of slots 158 nearest to leg 136 is angled toward undersurface 46 as shown in FIGS. 10 and 16. Support strut 146 is coupled to channel member 150 by a slide pin 160 which is received by slots 158 for sliding movement.

First leg assembly 28 has a stored position wherein leg 136 is folded against undersurface 46 of first table section 22. When first and second leg assemblies 28, 30 are both in their respective stored positions, first and second table sections 22, 24 can be folded to the collapsed position without interference from first and second leg assemblies 28, 30.

When first leg assembly 28 is in the stored position, support strut 146 is positioned to lie within slide channel 156 between side walls 152 and slide pin 160 is positioned to lie adjacent to innermost slot edges 162 which define inner ends of slots 158, as shown in FIGS. 6 and 9. When first and second table sections 22, 24 are in the table position, leg 136 can be manually pivoted from the stored position to a support position causing pivot member 144 to rotate within pivot collars 145 and causing upper cross member 142 to pull support strut 146 out of slide channel 156. Pivoting movement of leg 136 also causes coupling collar 148 to pivot relative to upper cross member 142 while slide pin 160 slides in slots 158 away from innermost slot edges 162 toward the angled end portions of slots 158.

When slide pin 160 reaches the angled end portions of slots 158, a bent leaf spring 164 engages slide pin 160 to urge slide pin into contact with outermost slot edges 166 which define outer ends of slots 158, as shown in FIG. 16. When slide pin 160 contacts outermost slot edges 166, leg assembly 28 is in the support position having leg 136 extending away from undersurface 46 of first table section 22, as shown in FIGS. 1–5 and 8. Bent leaf spring 164 and channel member 150 cooperate to lock support strut 146 and leg 136 in the support position. When leg assembly 28 is moved out of the support position toward the stored position, slide pin 160 causes bent leaf spring 164 to deflect so that slide pin 160 can slide from the angled portion of slot 158 into the longitudinal portion of slot 158.

Movement of leg assembly 28 from the support position toward the stored position is similar but opposite to the movement of leg assembly 28 from the stored position toward the table support position. For example, support strut 146 pushes slide pin 160 away from outermost slot edges 166 and toward innermost slot edges 162, and upper cross member 142 pushes support strut 146 into slide channel 156 of channel member 150.

Figure 18:
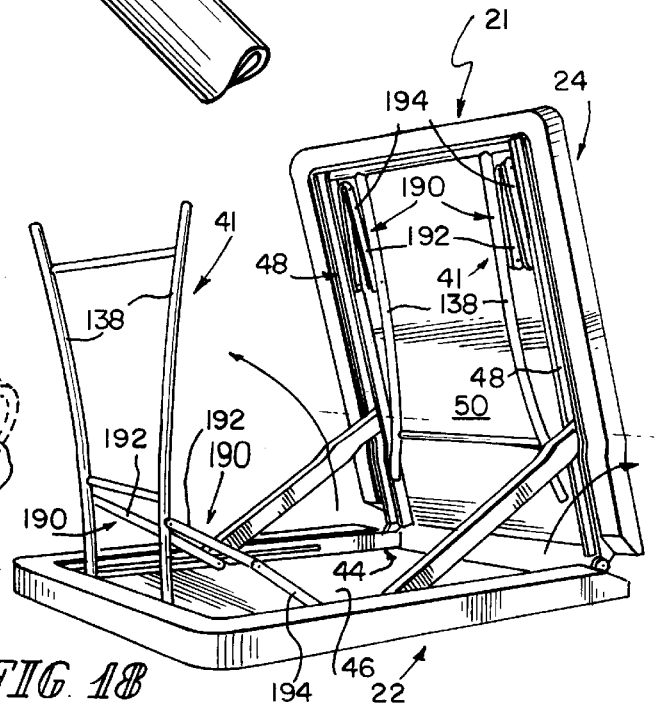
FIG. 18 is a perspective view of an alternative embodiment of the folding table in accordance with the present invention showing each leg assembly having a pair of spaced-apart leg support linkages which are opened to an in-line configuration when a corresponding leg is extended to the support position to lock the leg in the support position and which are folded into a side-by-side configuration adjacent to the undersurface of a respective table section when a corresponding leg is pivoted to the stored position.

An alternative embodiment of a folding table 21 in accordance with the present invention includes two leg assemblies 41 each of which is mounted to undersurfaces 46, 50 of respective first and second table sections 22, 24, as shown in FIG. 18. Each leg assembly 41 includes a pair of spaced-apart leg support linkages 190 having a first link 192 and a second link 194 pivotably coupled to first link 192. Each first link 192 is pivotably coupled to a corresponding curved upright 138 and each second link is pivotably coupled to a corresponding first or second table rail 44, 48.

First and second links 192, 194 are opened to an in-line configuration when a corresponding leg 136 is extended to a support position to lock leg assembly 41 in the support position, as shown in FIG. 18. First and second links 192, 194 are folded into a side-by-side configuration adjacent to undersurfaces 46, 50 of first and second table sections 22, 24 when leg assemblies 41 are moved to a stored position having legs 136 adjacent to undersurfaces 46, 50.

Although the invention has been described in detail with reference to certain preferred embodiments, variations and modifications exist within the scope and spirit of the invention as described and as defined in the following claims.

I claim:

1. A table comprising a first table section, a second table section pivotably coupled to the first table section for movement about a pivot axis between a table position in which the first and second table sections are aligned in horizontal relation and a collapsed position in which the first and second table sections are folded together, a pair of legs including a first leg coupled to the first table section for movement between a storage position adjacent to the first table section and a support position extending away from the first table section and a second leg coupled to the second table section for movement between a storage position adjacent to the second table section and a support position extending away from the second table section, and a reinforcing assembly including a first table rail coupled to the first table section, a second table rail coupled to the second table section, and a support rail coupled to the first table rail for sliding movement and coupled to the second table rail for pivoting movement, the support rail pivoting relative to the second table rail and sliding relative to the first table rail as the first and second table sections are moved between the table position and the collapsed position, the support rail being a rigid member that engages the first table rail and the second table rail to prevent the first and second table sections from pivoting past the table position as the first and second table sections are moved from the collapsed position into the table position.

2. The table of claim 1, wherein the first table rail includes a pair of spaced-apart side walls defining a first channel therebetween, the second table rail includes a pair of spaced-apart side walls defining a second channel therebetween, a first portion of the support rail is received in the first channel and a second portion of the support rail is received in the second channel when the first and second table sections are in the table position.

3. The table of claim 2, wherein the first and second table rails are arranged in end-to-end relation when the first and second table sections are in the table position so that about half of the support rail is in the first channel and about half of the support rail is in the second channel when the first and second table sections are in the table position.

4. The table of claim 3, wherein the side walls of the first table rail each include a rail edge facing away from the first table section, the side walls of the second table rail each include a rail edge facing away from the second table section, and the rail edges of the side walls of the first table section engage the rail edges of the side walls of the second table section when the first and second table sections are in the collapsed position so that about half of the support rail is in the first channel and about half of the support rail is in the second channel when the first and second table sections are in the collapsed position.

5. The table of claim 2, wherein a substantial portion of the support rail is positioned to lie outside the first channel and outside the second channel when the first and second table sections are at a position midway between the table position and the collapsed position.

6. The table of claim 5, wherein the first table section forms a right angle with the second table section when the first and second table sections are at the position midway between the table position and the collapsed position and the support rail forms an angle of about forty-five degrees with the first table section and with the second table section when the first and second table sections are at the position midway between the table position and the collapsed position.

7. The table of claim 2, wherein each of the side walls of the first table rail is formed to include a slot that is parallel with the first table section and further comprising a sliding pin including a central portion positioned to lie in the first channel and slide portions received in the respective slots formed in the side walls of the first table rails, the sliding pin being slidable in the slots relative to the first table rail, and the support rail being coupled to the sliding pin inside the first channel.

8. The table of claim 1, wherein the first table rail has a U-shaped cross section and includes a first mounting wall contacting the first table section and a pair of side walls extending away from the first mounting wall in spaced-apart parallel relation to define a first channel therebetween, the second table rail has a U-shaped cross section and includes a second mounting wall contacting the second table section and a pair of side walls extending away from the second mounting wall in spaced-apart parallel relation to define a second channel therebetween, the support rail has a U-shaped cross section and includes a bottom wall and a pair of side walls extending away from the bottom wall in spaced-apart parallel relation, a first portion of the side walls of the support rail is positioned to lie between the side walls of the first table rail when the first and second table sections are in the table position, and a second portion of the side walls of the support rail is positioned to lie between the side walls of the second table rail when the first and second table sections are in the table position.

9. The table of claim 8, wherein the side walls of the first table rail each include a rail edge facing away from the first table section, the side walls of the second table rail each include a rail edge facing away from the second table section, a first portion of the bottom wall of the support rail is substantially even with the rail edges of the side walls of the first table rail when the first and second table sections are in the table position, and a second portion of the bottom wall of the support rail is substantially even with the rail edges of the side walls of the second table rail when the first and second table sections are in the table position.

10. The table of claim 9, further comprising a first lateral rim appended to the first table section adjacent to the first table rail and a second lateral rim appended to the second table section adjacent to the second table rail, each of the first and second lateral rims including a bottom surface that is substantially even with the rail edges of the side walls of the respective first and second table rails.

11. The table of claim 8, wherein the side walls of the support rail each include a bracing edge facing away from the bottom wall, a first portion of each bracing edge engages the first mounting wall of the first table rail when the first and second table sections are in the table position, and a second portion of each bracing edge engages the second mounting wall of the second table rail when the first and second table sections are in the table position.

12. The table of claim 11, wherein the bracing edges face toward the first mounting plate and away from the second mounting plate when the first and second table sections are in the collapsed position.

13. The table of claim 1, wherein the first table section is formed to include a first elongated recess, the second table section is formed to include a second elongated recess, the first table rail is coupled to the first table section in the first elongated recess, and the second table rail is coupled to the second table section in the second elongated recess.

14. A table comprising a first table section, a second table section pivotably coupled to the first table section for movement about a pivot axis between a table position in which the first and second table sections are aligned in horizontal relation and a collapsed position in which the first and second table sections are folded together, a pair of legs including a first leg coupled to the first table section for movement between a storage position adjacent to the first table section and a support position extending away from the first table section and a second leg coupled to the second table section for movement between a storage position adjacent to the second table section and a support position extending away from the second table section, and a pair of spaced-apart reinforcing assemblies coupling the first and second table sections together, each reinforcing assembly including a first table rail coupled to the first table section, a second table rail coupled to the second table section, and a support rail coupled to the respective first table rail for sliding movement and coupled to the respective second table rail for pivoting movement, each of the support rails pivoting relative to the respective second table rail and sliding relative to the respective first table rail as the first and second table sections are moved between the table position and the collapsed position, each of the support rails being a rigid member that engages the respective first table rail and the respective second table rail to prevent the first and second table sections from pivoting past the table position as the first and second table sections are moved from the collapsed position into the table position, and the first leg being positioned to lie between the pair of first table rails and the second being positioned to lie between the pair of second table rails.

15. The table of claim 14, wherein each of the first and second legs includes a pivot member adjacent to the respective first and second table sections and further comprising a pair of first pivot collars and a pair of second pivot collars, each of the first pivot collars being coupled to a respective one of the first table rails and each of the second pivot collars being coupled to a respective one of the second table rails, the pivot member of the first leg being coupled to the first pivot collars for pivoting movement, and the pivot member of the second leg being coupled to the second pivot collars for pivoting movement.

16. The table of claim 15, wherein each of the first table rails includes a side wall arranged in perpendicular relation to the first table section, each of the second table rails includes a side wall arranged in perpendicular relation to the second table section, each of the first pivot collars is coupled to the respective side wall of the first table rails so that the first pivot collars and the pivot member of the first leg are positioned to lie between the side walls of the first table rails, and each of the second pivot collars is coupled to the respective side wall of the second table rails so that the second pivot collars and the pivot member of the second leg are positioned to lie between the side walls of the second table rails.

17. The table of claim 14, wherein each of the reinforcing assemblies further includes a hinge assembly, each of the hinge assemblies includes a first hinge plate coupled to the respective first table rail, a second hinge plate coupled to the respective second table rail, and a pivot pin coupling the respective first and second hinge plate together at the pivot axis.

18. The table of claim 17, wherein each of the first table rails includes a side wall arranged in perpendicular relation to the first table section, each of the second table rails includes a side wall arranged in perpendicular relation to the second table section, the side walls of the first table rails and the side walls of the second table rails are chamfered in a region adjacent to the pivot axis to provide a space in which a portion of each of the pivot pins of the respective hinge assemblies are received.

19. The table of claim 14, wherein each of the first table rails includes an end surface adjacent to the pivot axis, each of the second table rails includes an end surface adjacent to the pivot axis, and the end surfaces of the first table rails abut the end surfaces of the respective second table rails when the first and second table sections are in the table position to assist the support rails in preventing the first and second table sections from pivoting past the table position as the first and second table sections are moved from the collapsed position into the table position.

20. A table comprising a table top, a channel member coupled to the table top and including a pair of spaced-apart side walls defining a channel therebetween, each side wall being formed to include a slot, a slide pin including a central portion positioned to lie in the channel and slide portions received in the respective slots formed in the side walls of the channel member, the slide pin being slidable in the slots relative to the channel member, a leg pivotably coupled to the table top for movement between a stored position adjacent to the table top and a support position extending away from the table top, and a support strut including a first end pivotably coupled to the leg and a second end pivotably coupled to the central portion of the slide pin inside the channel of the channel member, the second end of the support strut moving within the channel and the first end of the support strut pivoting relative to the leg as the leg is moved between the storage and support positions.

21. The table of claim 20, wherein each of the slots includes a longitudinal portion substantially parallel with the table top and an angled end portion extending from the longitudinal portion toward the table top at an angle.

22. The table of claim 21, wherein the angled portion of each of the slots is configured to extend toward the table top so that the support strut is perpendicular with the angled portions of the slots when the leg is in the support position.

23. The table of claim 21, wherein the slide pin includes at least one end portion that extends away from the respective slide portion past the associated side wall of the channel member and each side wall includes an outermost edge at which the angled portions of the respective slots terminate, and further comprising a leaf spring coupled to the channel member and arranged to engage the end portion of the slide pin to bias the slide portions of the slide pin into contact with the respective outermost edges when the leg is in the support position to secure the leg in the support position.

24. The table of claim 23, wherein the leaf spring includes a first portion that extends across the angled portion of the associated slot and a second portion that extends across the longitudinal portion of the associated slot, engagement of the slide pin with the first portion of the leaf spring as the leg is moved from the support position toward the storage position deflects the leaf spring to a position that allows the slide pin to move from the angled portions of the slots into the longitudinal portions of the slots, and engagement of the slide pin with the second portion of the leaf spring as the leg is moved from the storage position toward the support position deflects the leaf spring to a position that allows the slide pin to move from the longitudinal portions of the slots into the angled portions of the slots.

25. The table of claim 20, wherein most of the support strut is positioned to lie in the channel between the side walls of the channel member when the leg is in the stored position and the leg is positioned to lie outside the channel when in the stored position.

26. The table of claim 25, wherein the leg includes a pair of uprights, an upper cross member extending between the pair of uprights, and a lower cross member extending between the pair of uprights, the support strut is pivotably coupled to the upper cross member, and the channel member is positioned to lie between the pair of uprights and between the upper and lower cross members when the leg is in the storage position.

27. A table comprising a table top, a channel member coupled to the table top and defining a channel on the table top, a leg pivotably coupled to the table top for movement between a stored position adjacent to the table top and a support position extending away from the table top, the leg including a pair of spaced-apart uprights and a cross member extending between the uprights, a support strut extending between the cross member of the leg and the channel member, the support strut being coupled to the channel member for sliding movement, and a coupling collar coupled to the cross member for pivoting movement, the support strut being coupled to the coupling collar, and the coupling collar including two substantially identical half pieces that are coupled together.

28. The table of claim 27, wherein each of the half pieces of the collar includes a bent flange and a straight flange, the bent flange of each half piece includes a groove that receives a portion of the straight flange of the other half piece.

29. The table of claim 28, wherein each of the half pieces of the collar includes a pair of fastening plates, each fastening plate is formed to include an aperture, each fastening plate of one of the half pieces abuts a respective one of the fastening plates of the other of the half pieces so that the apertures formed in the abutting fastening plates are aligned.

30. The table of claim 29, wherein each of the half pieces of the collar includes a support strut-receiving portion positioned to lie between the fastening plates of the respective half piece and the support strut-receiving portion of one of the half pieces cooperates with the support strut-receiving portion of the other of the half pieces to provide the collar with a longitudinal opening in which a portion of the support strut is received.

31. The table of claim 29, wherein each of the half pieces of the collar includes a cross member-receiving portion connecting the bent flange and the straight flange to the fastening plates and the cross member-receiving portion of one of the half pieces cooperates with the cross member-receiving portion of the other of the half pieces to provide the collar with a transverse opening in which a portion of the cross member of the leg is received.

32. The table of claim 27, wherein each of the half pieces of the collar includes a cross member-receiving portion and a support strut-receiving portion appended to the cross-member receiving portion, the support strut-receiving portion of one of the half pieces cooperates with the support strut-receiving portion of the other of the half pieces to provide the collar with a longitudinal opening in which a portion of the support strut is received, and the cross member-receiving portion of one of the half pieces cooperates with the cross member-receiving portion of the other of the half pieces to provide the collar with a transverse opening in which a portion of the cross member of the leg is received.

33. A table comprising a table top, a leg coupled to the table top for movement between a stored position adjacent to the table top and a support position extending away from the table top, the leg including a pair of spaced-apart uprights and a cross member extending between the uprights, a support strut extending between the cross member of the leg and the table top, and a coupling collar coupled to the cross member and the support strut, the coupling collar including two substantially identical half pieces that are coupled together.

34. The table of claim 33, wherein each of the half pieces of the collar includes a bent flange and a straight flange and the bent flange of each half piece includes a groove that receives a portion of the straight flange of the other half piece.

35. The table of claim 34, wherein each of the half pieces of the collar includes a pair of fastening plates, each fastening plate is formed to include an aperture, and each fastening plate of one of the half pieces abuts a respective one of the fastening plates of the other of the half pieces so that the apertures formed in the abutting fastening plates are aligned.

36. The table of claim 35, wherein each of the half pieces of the collar includes a support strut-receiving portion positioned between the fastening plates of the respective half piece and the support strut-receiving portion of one of the half pieces cooperates with the support strut-receiving portion of the other of the half pieces to provide the collar with a longitudinal opening in which a portion of the support strut is received.

37. The table of claim 35, wherein each of the half pieces of the collar includes a cross member-receiving portion connecting the bent flange and the straight flange to the fastening plates and the cross member-receiving portion of one of the half pieces cooperates with the cross member-receiving portion of the other of the half pieces to provide the collar with a transverse opening in which a portion of the cross member of the leg is received.

38. The table of claim 33, wherein each of the half pieces of the collar includes a cross member-receiving portion and a support strut-receiving portion appended to the cross-member receiving portion, the support strut-receiving portion of one of the half pieces cooperates with the support strut-receiving portion of the other of the half pieces to provide the collar with a longitudinal opening in which a portion of the support strut is received, and the cross member-receiving portion of one of the half pieces cooperates with the cross member-receiving portion of the other of the half pieces to provide the collar with a transverse opening in which a portion of the cross member of the leg is received.

39. A table comprising a table top, a leg coupled to the table top for movement between a stored position adjacent to the table top and a support position extending away from the table top, the leg including a pair of spaced-apart uprights and a cross member extending between the uprights, a support strut extending between the cross member of the leg and the table top, and a coupling collar coupled to the cross member and the support strut, the coupling collar including first and second pieces that are coupled together, the first piece of the collar including a body portion and a first flange coupled to the body portion, the second piece of the collar including a body portion and a second flange coupled to the body portion of the second piece, the first flange of the first piece of the collar including a groove that receives a portion of the second flange of the second piece.

40. The table of claim 39, wherein the first piece of the collar includes a second flange coupled to the body portion of the first piece, the second piece of the collar includes a first flange coupled to the body portion of the second piece, and the first flange of the second piece of the collar includes a groove that receives a portion of the second flange of the first piece.

41. The table of claim 40, wherein the first flange of the first piece is spaced apart from the second flange of the first piece.

42. The table of claim 39, wherein the first flange of the first piece includes a bend defining the groove.

43. The table of claim 42, wherein the second flange of the second piece is straight to fit within the bend of the first flange.

44. The table of claim 39, wherein the body portions of the first and second pieces cooperate to define a strut-receiving opening and the support strut is positioned in the strut-receiving opening.

45. The table of claim 39, wherein the body portions of the first and second pieces cooperate to define a cross member-receiving opening and the cross member is positioned in the cross member-receiving opening.

46. The table of claim 45, wherein the body portions of the first and second pieces cooperate to define a strut-receiving opening and the support strut is positioned in the strut-receiving opening.

47. The table of claim 45, wherein the collar is pivotably coupled to the cross member.

48. The table of claim 39, wherein the first and second pieces include fastening plates coupled to the body portions and the fastening plate of the first piece is coupled to the fastening plate of the second piece.

49. The table of claim 39, wherein the first piece is substantially identical to the second piece.

50. The table of claim 39, wherein the body portions are T-shaped.

* * * * *